US008465356B2

(12) United States Patent
Rosendo

(10) Patent No.: US 8,465,356 B2
(45) Date of Patent: Jun. 18, 2013

(54) DISPLAY PUZZLE

(76) Inventor: Gonzalez Rosendo, Carlsbad, CA (US)

( * ) Notice: Subject to any disclaimer, the term of this patent is extended or adjusted under 35 U.S.C. 154(b) by 0 days.

(21) Appl. No.: 13/302,146

(22) Filed: Nov. 22, 2011

(65) Prior Publication Data

US 2012/0302303 A1 Nov. 29, 2012

Related U.S. Application Data

(60) Provisional application No. 61/415,968, filed on Nov. 22, 2010.

(51) Int. Cl.
*A63F 13/08* (2006.01)

(52) U.S. Cl.
USPC ..... 463/9; 273/153 S

(58) Field of Classification Search
USPC ..... 463/9
See application file for complete search history.

(56) References Cited

U.S. PATENT DOCUMENTS

| | | | | |
|---|---|---|---|---|
| 6,687,128 | B2 * | 2/2004 | Tokuhara | 361/724 |
| 7,371,177 | B2 * | 5/2008 | Ellis et al. | 463/42 |
| 2003/0148700 | A1 * | 8/2003 | Arlinsky et al. | 446/91 |
| 2009/0305760 | A1 * | 12/2009 | Shimizu | 463/9 |
| 2010/0001923 | A1 * | 1/2010 | Zilber | 345/1.1 |
| 2012/0184341 | A1 * | 7/2012 | Dai et al. | 463/9 |

* cited by examiner

*Primary Examiner* — Tramar Harper
(74) *Attorney, Agent, or Firm* — John R Ross; John R. Ross, III

(57) ABSTRACT

A geometric toy having a two or more axes originating from the center of the toy. The geometric toy includes cubelets. A predetermined number of the cubelets are rotatable about the axes. Display screens are connected to the cubelets and allow for the display of preprogrammed images. At least one microprocessor is in communication with the display screens to control the display of images on the display screens. A connection means allows for the rotation of the cubelets about the axes while still maintaining communication between the microprocessor and the display screens to provide for the continual display of images on the display screen.

8 Claims, 22 Drawing Sheets

Downstream message flow

File Edit View Help Rocker's iToy iToy not present on the Cradle

Summary Media Admin Sounds

Power Options

Dim LEDs to 25% after 30 seconds.
Dim LEDs to 50% after 60 seconds.
Enter sleep mode after 2 minutes.
Enter hibernation mode after 5 minutes iToy Info S/N: A2E001 Upgrade
Firmware Version: 1.00

Capacity Sync

FIG. 25

File Edit View Help Rocker's iToy iToy not present on the Cradle

Summary Media Admin Sounds

| Scheme | Front | Right | Bottom | Back | Left | Top | Scramble |
|---|---|---|---|---|---|---|---|
| Padres | 8CFF | 9003 | 34343 | dfde | dfe5 | 334 | dfee3 |
| MyToy | 8CFF | 9003 | 34343 | dfde | dfe5 | 334 | dfee3 |
| Classic | 8CFF | 9003 | 34343 | dfde | dfe5 | 334 | dfee3 |
| Classic | 8CFF | 9003 | 34343 | dfde | dfe5 | 334 | dfee3 |

iToy Info

S/N: A2E001 Upgrade
Firmware Version: 1.00

Capacity Sync

FIG. 26

Rocker's iToy iToy not present on the Cradle

Summary Media Admin Sounds

Rocker's iToy
Capacity: 16 Mbytes
Software Version: 1.00
Serial Number A2E001

Top Scores

CDE - iToy - User 1
CDE - iToy - User 2
CDE - iToy - User 3
CDE - iToy - User 4
CDE - iToy - User 5

Options

✓ Auto sync when iToy is connected

Capacity

Sync

FIG. 27

File Edit View Help Rocker's iToy iToy not present on the Cradle

Summary Media Admin Sounds

| Scheme | Front | Right | Bottom | Back | Left | Top | Scramble |
|---|---|---|---|---|---|---|---|
| Padres | 8CFF | 9003 | 34343 | dfde | dfe5 | 334 | dfee3 |
| MyToy | 8CFF | 9003 | 34343 | dfde | dfe5 | 334 | dfee3 |
| Classic | 8CFF | 9003 | 34343 | dfde | dfe5 | 334 | dfee3 |
| Classic | 8CFF | 9003 | 34343 | dfde | dfe5 | 334 | dfee3 |

iToy Info

S/N: A2E001 Upgrade
Firmware Version: 1.00

Capacity

Sync

FIG. 28

File Edit View Help Rocker's iToy iToy not present on the Cradle

Summary Media Admin Sounds

| Scheme | Front | Right | Bottom | Back | Left | Top | Scramble |
|---|---|---|---|---|---|---|---|
| Padres | 8CFF | 9003 | 34343 | dfde | dfe5 | 334 | dfee3 |
| MyToy | 8CFF | 9003 | 34343 | dfde | dfe5 | 334 | dfee3 |
| Classic | 8CFF | 9003 | 34343 | dfde | dfe5 | 334 | dfee3 |
| Classic | 8CFF | 9003 | 34343 | dfde | dfe5 | 334 | dfee3 |

iToy Info

S/N: A2E001 Upgrade
Firmware Version: 1.00

Capacity Sync

DISPLAY PUZZLE

The invention relates to geometric puzzles and, more particularly, to geometric puzzles utilizing electronic display devices. This application claims the benefit of Provisional Application 61/415,968 filed Nov. 22, 2010, which is incorporated by reference herein.

BACKGROUND OF THE INVENTION

The prior art Rubik's Cube® is a well known puzzle within the art. The operation of the prior art Rubik's Cube® is described in U.S. Pat. No. 4,378,116 and U.S. Pat. No. 4,471,959. A general description of the prior art Rubik's Cube® follows. This information can be found on the World Wide Web at http://www.madehow.com/Volume-7/Rubik-s-Cube.html and general information regarding the prior art Rubik's Cube® at http://www.rubiks.com. The prior art Rubik's Cube® has six sides; each side is divided into nine smaller squares, referred to herein as cubelets. It generally appears to the user that all of the smaller cubelets can be moved; however, the center cubelet on each side actually can not be moved. Only the cubelets used to form the corners and edges can move. This is because the center cubelet on each side is in an attached position to an axis and can only be rotated in place about that axis as shown in FIG. 1.

When a prior art Rubik's Cube® is taken apart it can be seen that the center cubelets are connected to an axle like mechanisms to the inner core, refer to FIG. 2. The corner and edges pieces are not in a fixed position to any particular reference allowing them to move around the center cubelets. The cube maintains its shape because the corner and edge cubelets are held together in place and retained by the center cubelets. See FIG. 3.

Each piece has an internal stem that is retained by the center cubelets and trapped by the surrounding pieces. These stems are shaped to fit along a curved track that is created by the backs of the other pieces. Refer to FIG. 4.

The center cubelets are fixed with a spring and rivet and retain all the surrounding pieces. The spring exerts just the right pressure to hold all the pieces in place while giving enough flexibility for a smooth and forgiving function.

Puzzles such as the prior art Rubik's Cube® have created a lasting impression on numerous users. This type of brain teasing device has become a legend in itself. However, the display characteristics are outdated and the functionality of puzzles like the Rubik's Cube® has not kept up with modern day technology. Therefore, there remains a need within the art for puzzles that present the attributes commonly associated with modern day devices.

SUMMARY OF THE INVENTION

The present invention provides a geometric toy having two or more axes originating from a center core element of the toy. The geometric toy includes cubelets that are rotatable about the axes. The cubelets each include at least one display that allows for the display of preprogrammed images. At least one microprocessor is in communication with the display screens to control the display of images on the display screens. An electrical and data connection means allows for the rotation of the cubelets about the axes while still maintaining constant data and power communication between the microprocessor, the display screens and adjacent cubelets to provide for the continual display of images on the display screen.

BRIEF DESCRIPTION OF THE DRAWINGS

FIGS. 25-29 show preferred GUI pages.

DETAILED DESCRIPTION OF THE PREFERRED EMBODIMENTS

Figure 8:
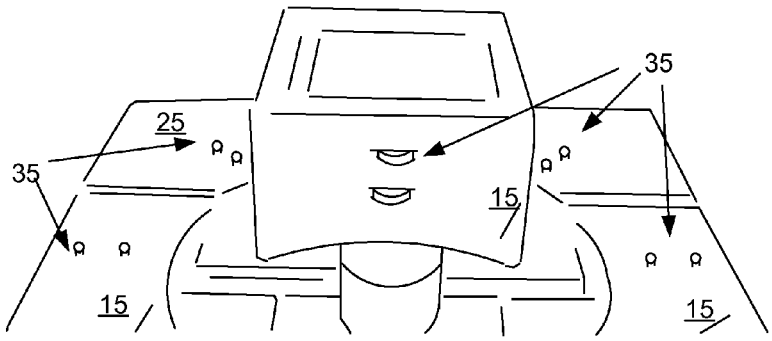
FIG. 8 shows a view of a preferred embodiment of the present invention.
Figure 8B:
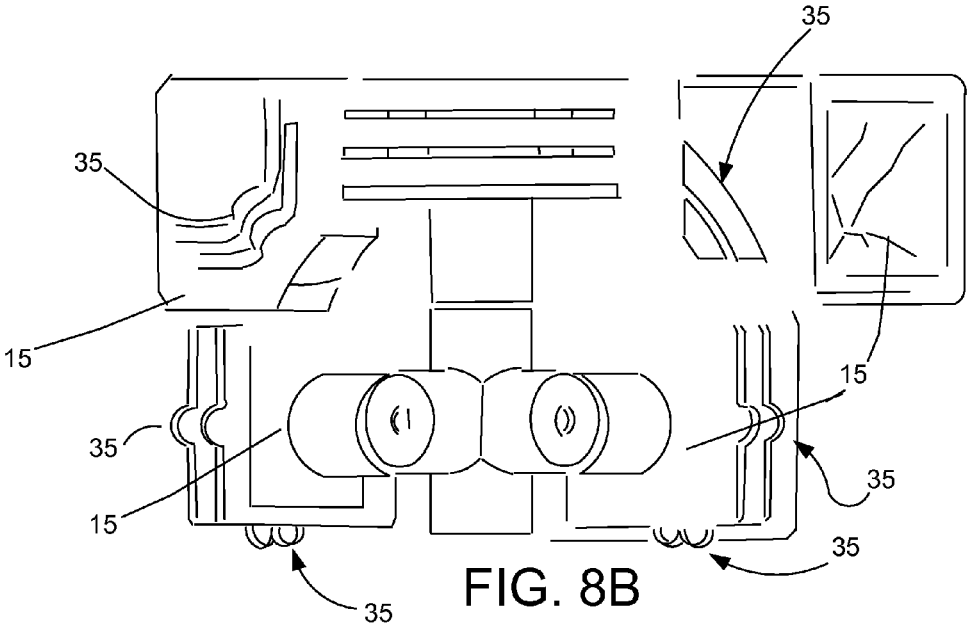
FIG. 8B shows a view detailing the arrangement of spring connectors for a preferred embodiment of the present invention.
Figure 24:
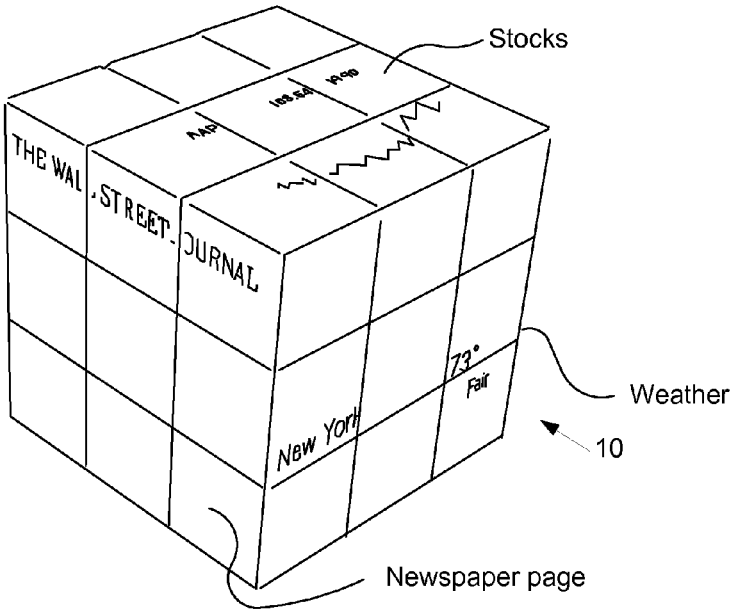
FIG. 24 shows a preferred embodiment of the present invention displaying different unrelated images on different sides of the cube.
Figure 29:
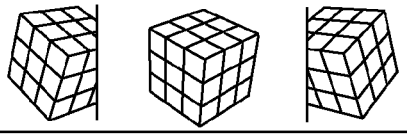

In a preferred embodiment, cube 10 (FIG. 17) is a cube shaped device that can be twisted and turned and manipulated in a fashion similar to that of the well known prior art Rubik's Cube® discussed above in the Background section. FIGS. 8 and 8B are illustrations of the internal workings of a cube 10. However cube 10 (FIG. 17) differs drastically from a prior art Rubik's Cube® for many reasons. For example, one major difference is that cube 10 is covered by multiple screens 22. Each screen 22 is capable of displaying a predetermined programmed image. The image may be a video image, still image or RGB (Red Green Blue) color pattern. These images can be presented so that the overall picture is a combination of the different images presented on each screen 22. For example, each screen 22 on the front side of cube 10 (FIG. 17) shows a small portion of baby's face. When combined, screens 22 function to show the overall image of the baby's face. In another embodiment, different unrelated images are preferably displayed on each screen 22. In another preferred embodiment, cube 10 is preferably programmed to display unrelated images on each side of the cube. For example, FIG. 24 shows cube 10 displaying a newspaper page on one side, a clock on another side and a stock chart on yet another side.

Cube 10 is programmable and includes microprocessors and batteries for power. In addition to multiple screens 22 speakers are included as well. A user is able to twist and turn and otherwise manipulate cube 10 in a fashion similar to the manner in which a prior art Rubik's Cube® is manipulated. However, the user is also able to view a variety of images from screens 22. He can view cube 10 for entertainment (i.e., watch a video or look at pictures) or function (i.e., look at a calendar or an alarm clock). He can play with cube 10 by manipulating it. Images will be displayed as the cube is manipulated in accordance with programming. For example, in this fashion the user can solve a variety of puzzle types.

Figure 1:
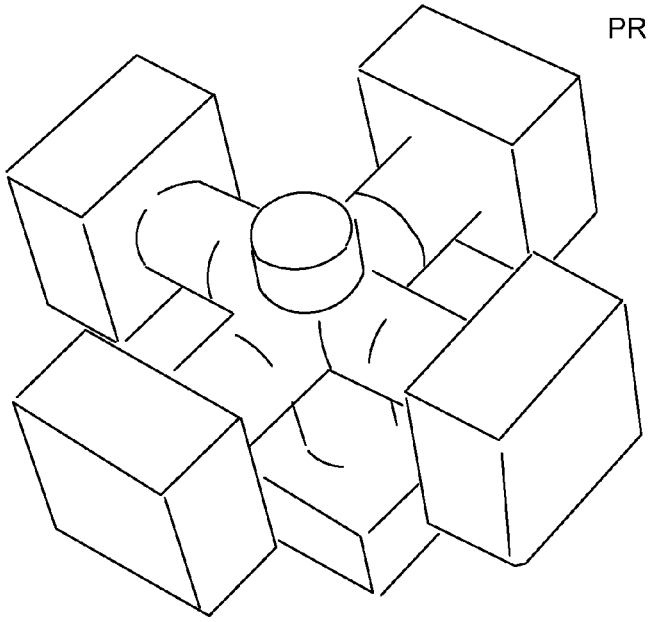
FIGS. 1-4 show views of a prior art Rubik's Cube.
Figure 2:
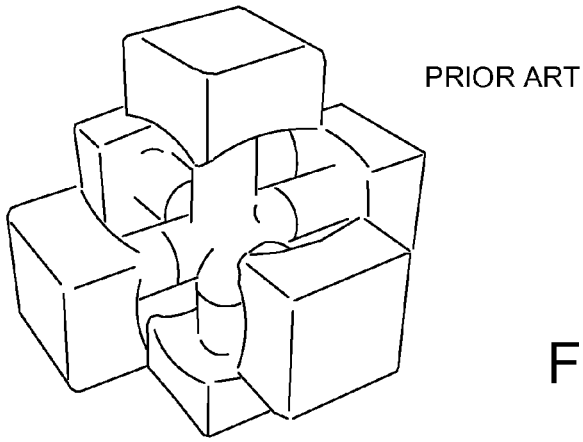
Figure 3:
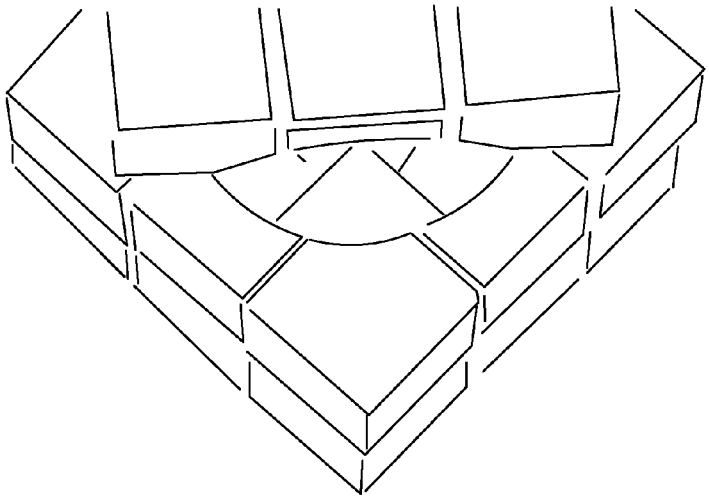
PRIOR ART FIG. 3
Figure 4:
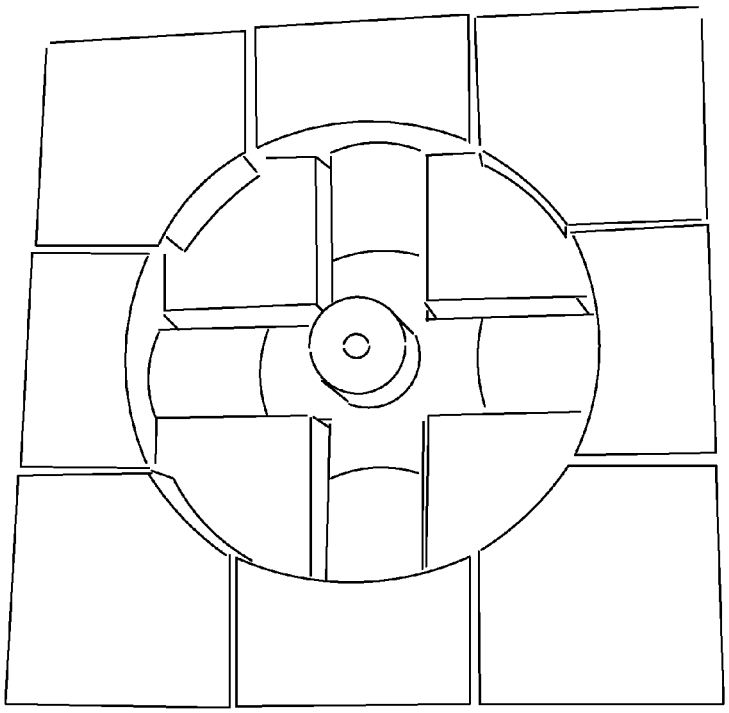
FIG. 4 PRIOR ART
Figure 5:
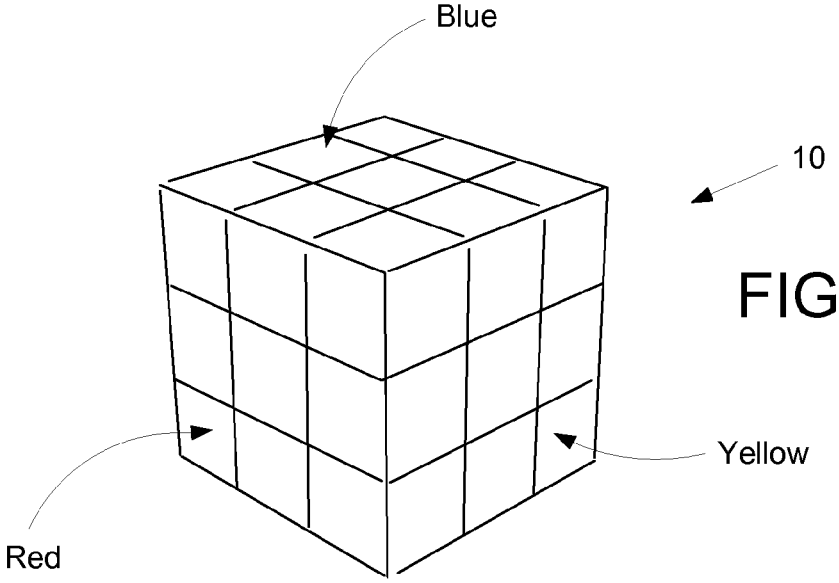
FIG. 5 shows one preferred embodiment of the present invention having an all blue side, an all red side and an all yellow side.

In a solved state, cube 10 has six sides, with each side made up of nine small cubelets each of which having a display indicating they are part of that side (see FIG. 5). For example, FIG. 5 shows an all blue side, an all yellow side and an all red side. The display included with each cubelet is preferably associated in some manner with a puzzle. Embodiments can be created wherein the cube embodiment is highly programmable or embodiments of limited or no programmability can be created. In a preferred embodiment, digital pictures are formed from each side in either still or video form. The center cubelets are attached to an axle that allows rotation of that center cubelets only as allowed by its manner of attachment to the axle (or core). The cubelets are preferably provided with communication and algorithmic logic (sophisticated software) thereby allowing them to communicate with a "master cubelet" (one of the four corner pieces) as well as each other. The communication mechanism is preferably either hard wired or wireless or a combination of both. A cube embodiment, having six sides; similar to a prior art Rubik's Cube®, is preferably provided with an interface to a computational element; As used here, a computational element is preferably either a computer, personal digital assistant (PDA) or other programmable type device (such as a smart phone).

Some Features of the Preferred Embodiments

The cubelets are connected (directly or indirectly) to each other by a redundant power and data architecture (see FIG. 6), allowing for the transmission of algorithmic logic and power simultaneously over the same physical connection medium. For example, custom spring connectors (shown as circles in FIG. 6) provide the physical layer for the data over power bus architecture. As can be seen each cubelet 15 has four redundant points of connection 35. This assures that power and data are always present, regardless of the orientation at any given time.

The master (one of the four corner cubelets) cubelet is provided with special system logic for controlling the displays associated with each "slave cubelet" (the other 25 cubelets in a 26 cubelet cube) and making continuous real-time analysis regarding the state of the cube, such as

- Has the cube been solved?
- Has the user pressed one of the six buttons (corresponding to two cubelets per x,y,z axis) to execute specific action, such as:
  - Help button
  - Volume up/down button
  - Power down/up button
  - Scramble/descramble button
  - Change the cube profile button
- Is the battery low?
- Has the no activity timer expired?
- Does the cube need to go into low power mode?
- Has the cube been docked with the PC (aka, computational device)?
- Has the user requested a "sync" operation (synchronization between the PC and the cube)?
- Is a firmware upgrade being performed?
- Etc. . . .

The displays are preferably digital pictures with a different picture on each side. Alternatively, the entire geometrically shaped puzzle is preferably programmed to show a continuous image or series of images. For example, the puzzle is preferably shaped as a sphere or a pyramid and having moving video programmed to show a series of images. A sphere could have the cubelets display a globe of the earth.

The puzzle is preferably provided with a "time out" setting and goes into sleep mode if the timeout period expires. The puzzle is preferably programmed to show a clock if the timeout period expires or show a different clock on each side while awake. The clock can perform the same functionality as a digital desktop clock, showing the time on a side or go into "screen saver mode" which will cause a preconfigured banner to rotate around the cube.

The puzzle is preferably provided with sufficient programming logic to play slide shows based on images being cycled every X (where X is user configurable via a custom PC based software suite) seconds around the various sides of the puzzle.

Audio is preferably provided that is preferably associated with a given display, slide show or video clips. Audio is preferably played via the internal speakers or if "docked" can be directed to the external "dock" speakers.

Providing a digitized puzzle allows the puzzle to digitally scramble or unscramble itself. Scrambling and/or unscrambling is preferably detected by "gesture movements', such as shaking the cube. Gesture movements are common place in modern day electronics, such as the iPhone™, which uses internal accelerometers and gyroscopes which can measure both direction and force and be made to respond accordingly through software.

The puzzle is preferably made to be wireless and stream digital data to other devices, via various modern-day physical electronics, such as Bluetooth, ZigBee, or Wifi.

The puzzle cubelets are preferably constructed with electronics that have Processing device(s) (such as a Central Processing Unit (CPU), Digital Signal Processor (DSP), Application Specific Integrated Circuit (ASIC), Field Programmable Gate Arrays (FPGAs) or microcontroller) and which are responsible for running sophisticated software algorithms used to control the images to be displayed by the cubelets as well as executing continuous real-time analysis of various "system events or states" as noted above. Binary images are preferably downloaded to the cubelets of the geometrically shaped puzzle and stored in a local memory. This is done via the "synching" operation previously referenced. Synching is accomplished when docked or is preferably accomplished through wireless means, such as using Bluetooth, Wifi, etc. The images (or sound or any other digital data) will be displayed according to the currently selected "profile", which is preferably changed at any time by the user using the "press and rotate" system feature (detected by accelerometers and/or gyroscopic electronics). Cube profiles are "synched" (synchronized) to the cube when the user "docks" the cube and performs as "sync" operation with the computational element.

Various algorithms are envisioned in accordance with varying embodiments that can provide for system functionality as shown by the following examples.

An algorithm is preferably used to establish connections (wired or wireless) with a host (such as a computer or PDA).

Another algorithm is preferably used to transfer data to and from the cubelets. Another algorithm can control the display of images on the cubelets.

Various algorithms are preferably derived for scrambling images, de-scrambling images, providing slide show or video functionality, and to provide audio functionality.

A PIN code is preferably provided to lock or unlock the functionalities provided by the puzzle.

Figure 7:
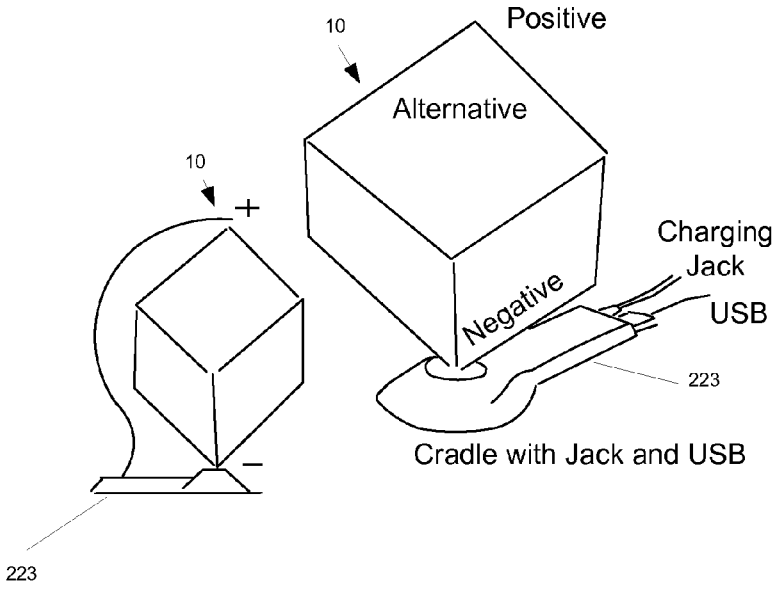
FIGS. 7 and 7B show preferred battery charging mechanisms
Figure 7B:
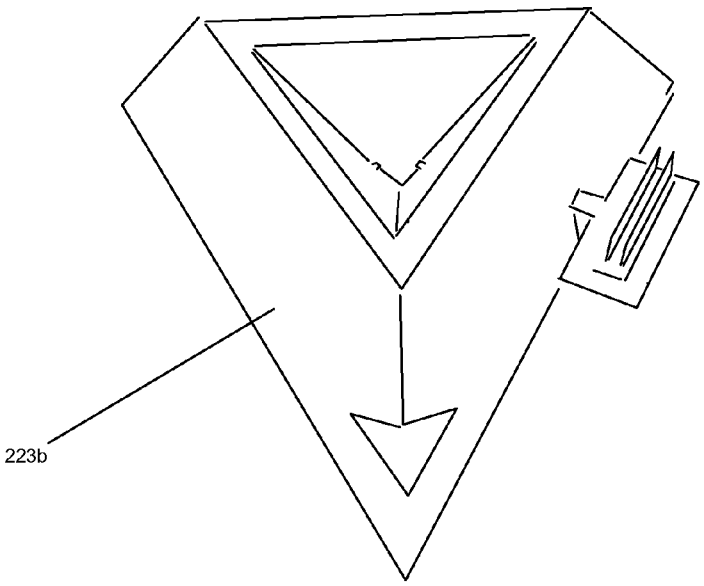

A dock 223 is preferably provided for cube 10 through which it can charge its internal batteries as well as synchronize itself with the host computing device (FIG. 7). FIG. 7B shows another preferred embodiment of a docking station 223*b*.

The geometric shape can also be used as display device and not a puzzle. The shape can provide images and/or independent "widget" (a small software program designed to implement a single function, such as displaying weather, or displaying stock ticker symbols, etc.) on each side.

These and other aspects, features and advantages of which the invention is capable of, will be apparent and elucidated from the following description of embodiments of the present invention, reference being made to the accompanying drawings.

Construction of a Preferred Embodiment

Figure 11:
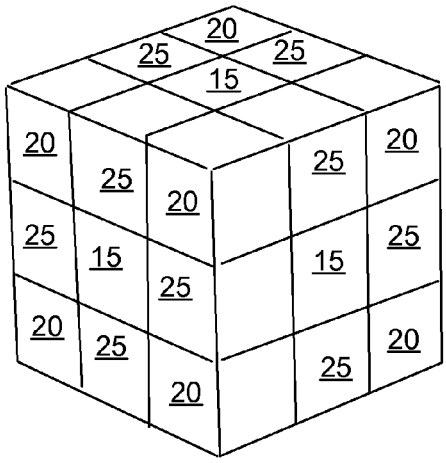
FIG. 11 shows preferred cubelet types.

FIG. 11 shows a preferred embodiment of the present invention. There are six center cubelets 15, eight corner cubelets 20 and twelve edge cubelets 25 for a total of 26 cubelets. FIG. 8 shows multiple cubelets 15 and 25 of cube 10. FIG. 8B shows a internal view of cube 10 and illustrates the location and arrangement of spring connectors 35. The custom pin connectors 35 shown earlier in FIG. 6 protrude through openings of cubelets 15. As stated above, there are redundant pin connectors 35 for each cubelet. Electronics 12 are contained within each cubelet. Electronics 12 are specific to each cubelet type. For example, a center piece 15 has different electronics than an edge piece 25 which has different electronics than a corner piece 20. Each edge piece preferably includes a rechargeable battery 232 which are used to provide power to the rest of cube 10, including center cubelets 15 and corner cubelets 20 in a mesh like network.

Each cubelet (15, 20, 25) preferably includes the following items. Electronics 12 are contained in the center of each cubelet 15 and include various custom printed circuit boards (PCBs) plus highly sophisticated firmware algorithms that continuously monitor and control all aspects of cube 10. In a preferred embodiment, each cubelet 15, 20 and 25 includes its own microprocessor (see FIG. 17B). Alternatively, cube 10 includes just one microprocessor housed inside one of the cubelets 15, 20 or 25. The one microprocessor is in constant communication with all cubelets 15, 20 and 25 via connectors 35 and is able to therefore control the images displayed on all display screens 22.

Figure 10:
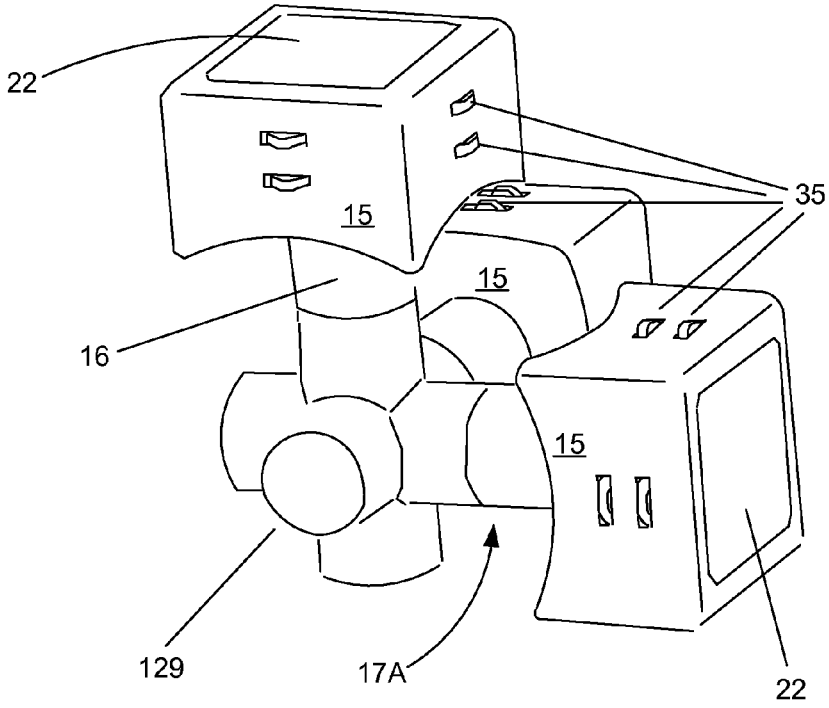
FIG. 10 shows elements of a preferred embodiment of the present invention.

Attached to the core 129 are six center cubelets 15 (FIG. 10). Each of the armatures 16 has a longitudinal axis with a core attachment mechanism 17*a*. The attachment mechanisms 17*a*, allow the center cubelets 15 to be held in an attached position at a fixed distance from the core and allow for each of the center cubelets 15 to be rotated in a plane perpendicular to the longitudinal axis of the armature 16. It should be noted that the attachment mechanism 17*a* can allow for the rotation of the center cubelets 15 relative to core 129. In a cube embodiment as shown in FIG. 10, there would be six center cubelets 15. Only five are shown for the sake of illustration.

Figure 12:
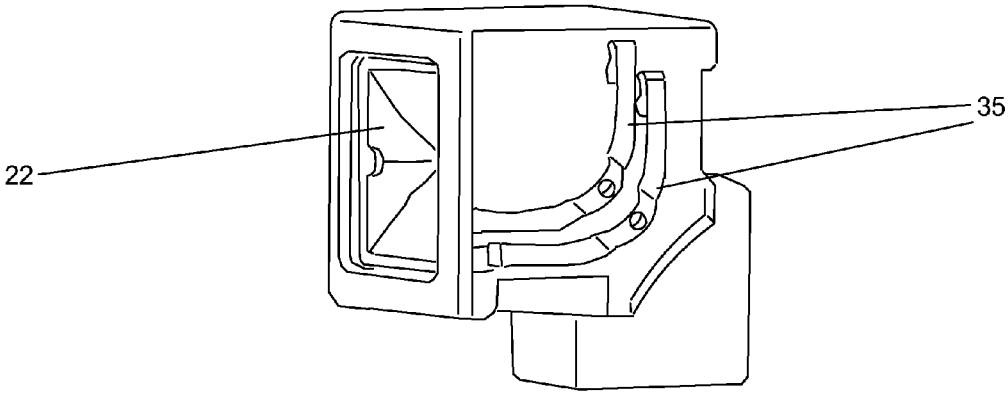
FIG. 12 shows elements of a preferred cubelet.

FIG. 10 shows only a portion of the embodiment to illustrate the attachment of the center cubelets 15 to the armatures 16 and core 129. The internals of every cubelet 15,20,25 contain electronics and a redundant data and power distribution architecture to provide power, data and command and control signals to all the surrounding cubelets 20,25 (FIG. 11). Each of the cubelets preferably includes a display screen 22 where RGB colors or images are preferably displayed (FIG. 12). As discussed above, custom spring connectors 35 protrude from each cubelet 15, 20, 25 to provide constant power and data to cube 10.

Figure 13:
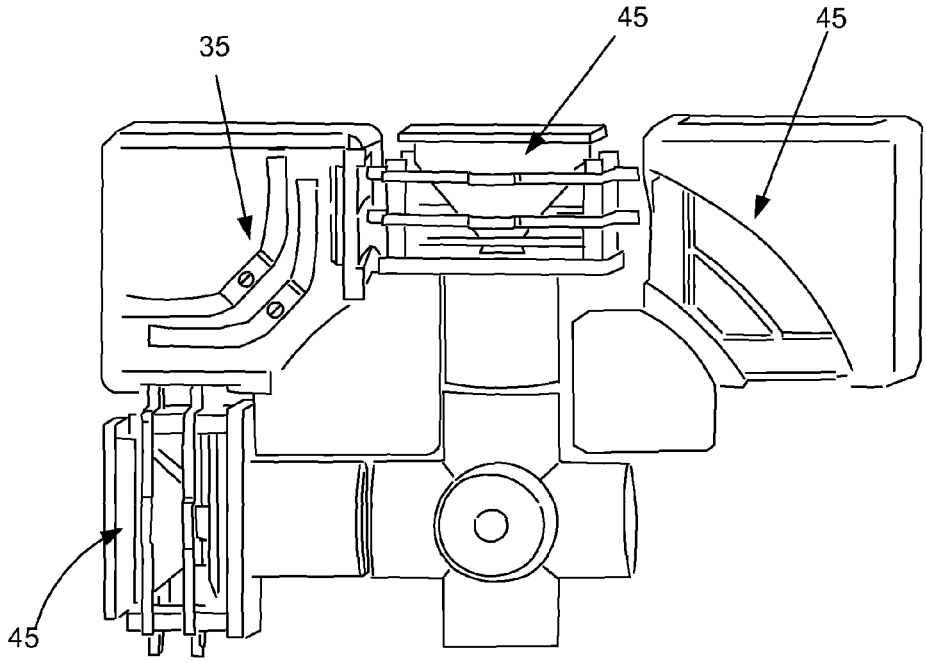
FIG. 13 shows preferred connectors and contact plates.
Figure 14:
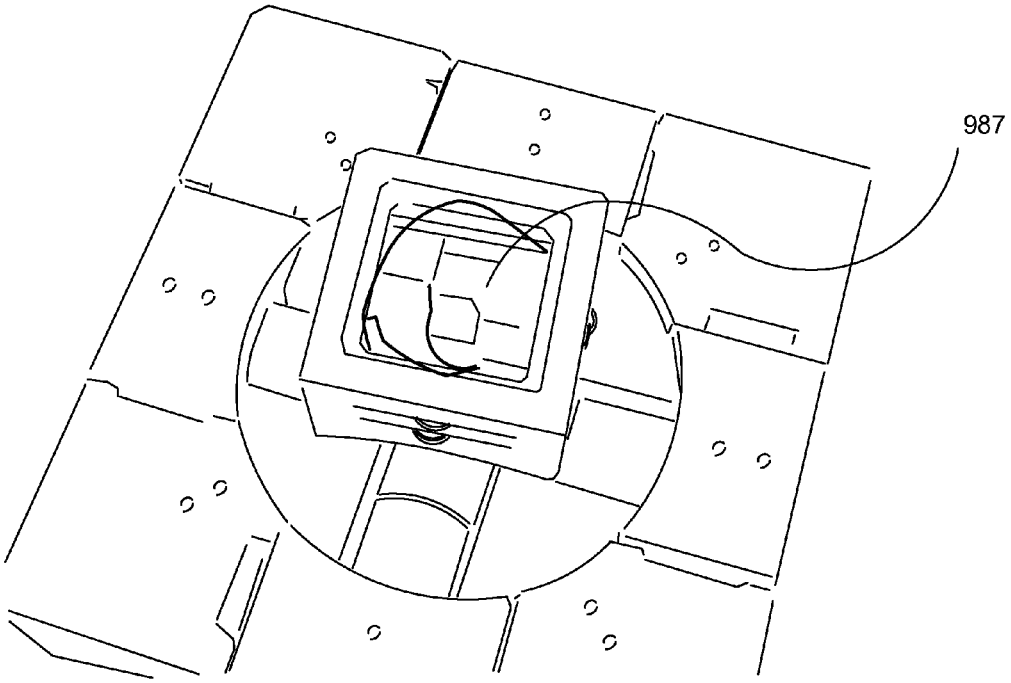
FIG. 14 shows internal elements of a preferred cubelet.

Connectors 35 and contact plates 45 are shown more clearly in FIG. 13. Each of the cubelets 15,20,25 are provided with connectors 35 and contact plates 45 that provide an interface to each other thus having a redundant connections for the distribution of power and data. The illustration in FIG. 14 shows a cubelet embodiment that is taken apart so that the internal workings are seen.

Figure 15:
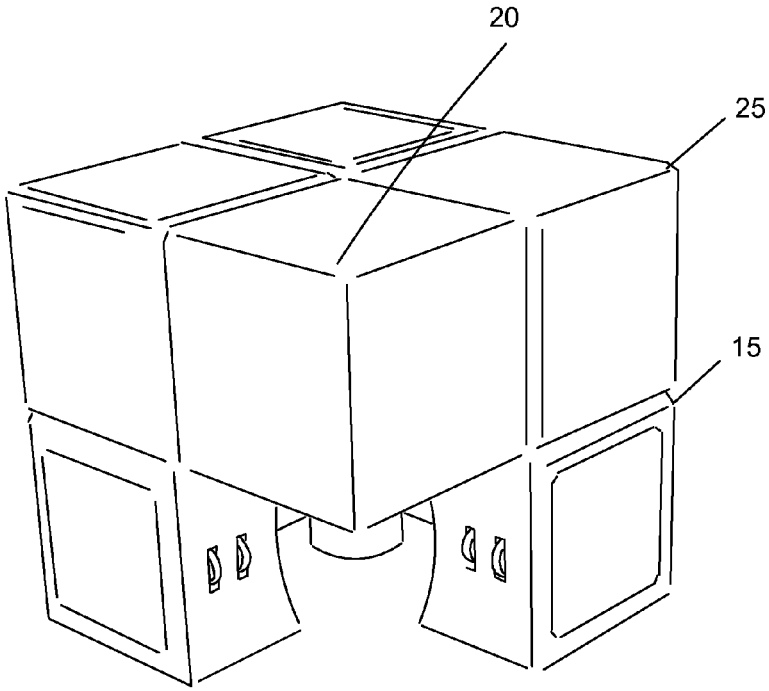
FIG. 15 shows preferred display screens.

FIG. 15 illustrates the completed cube embodiment shown in FIG. 10. The slave cubelets 20, 25 form the corner and edges pieces of the cube embodiment shown in FIG. 11 and are not attached to anything that prevents them form being moved around the center cubelets 15. The cube 10 maintains its shape due to applied forces between the corner and edge cubelets 20 and 25 that hold each other in place and are additionally held in place by the center cubelets.

Figure 16:
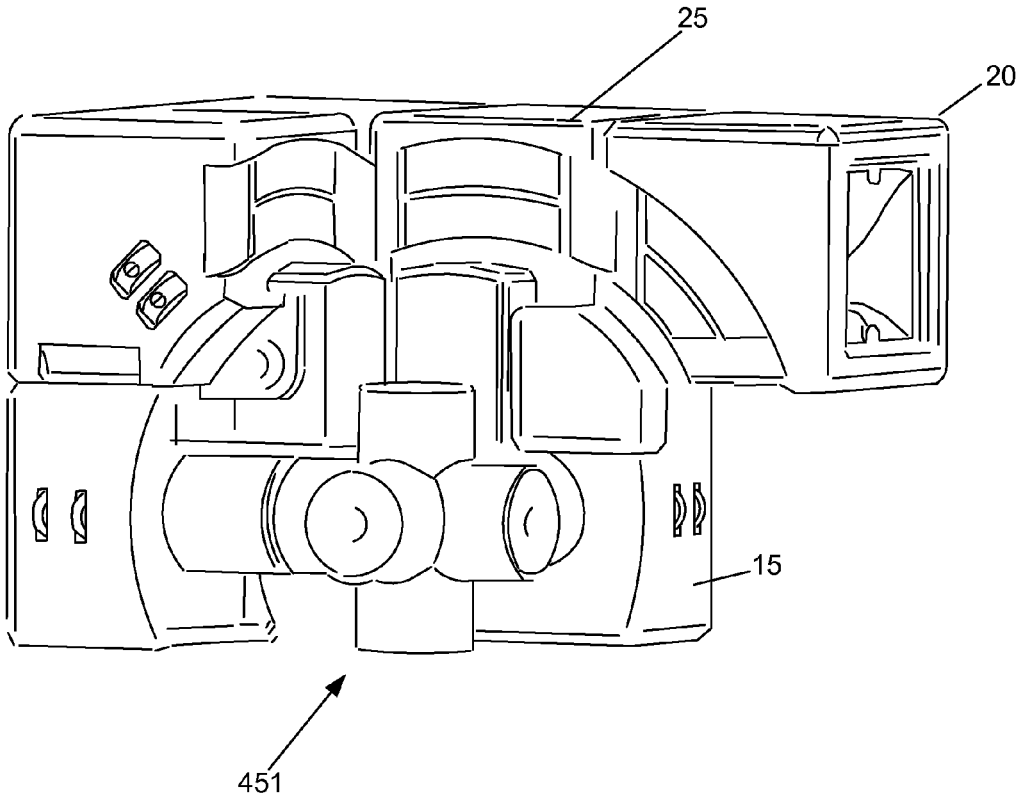
FIG. 16 shows a preferred cube assembly.

In one preferred embodiment, cube 10 illustrated in FIGS. 11 and 15 will have mechanics similar to a prior art Rubik's Cube®. Each piece can have an internal stem which allows the assembly and proper form retention of the center 15, corner 20 and edge 25 pieces to the core or hub—FIG. 16. These tabs are preferably shaped to fit a curved internal surface track 451 defined by the backs of the center cubelet 15, corner cubelet 20 and edge cubelet 25 as shown in FIG. 16. The center cubelets 15 are preferably fixed with a spring force and a retention mechanism to retain surrounding slave corner 20 and edge 25 cubelets. The spring force exerts pressure to hold the pieces to cube 10 in place while allowing sufficient flexibility for rotation of each side 6 with a smooth and forgiving function while always maintaining redundant electrical connection in the system utilizing connectors 35 as described above.

Figure 17:
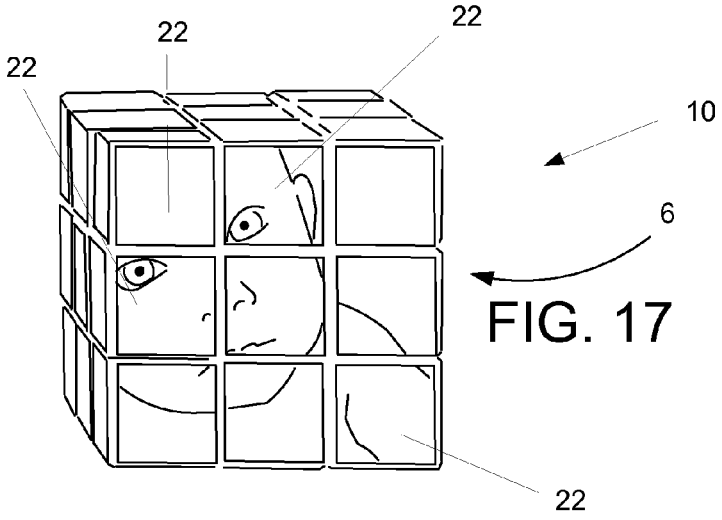
FIG. 17 shows a preferred embodiment of the present invention displaying an image utilizing display screens.

Cube 10 illustrated in FIGS. 10 and 11 retains the original functionality of the original prior art Rubik's Cube® with the various enhancements that provide a modern puzzle. Cube 10 contains nine screens 22 on each of its six sides (FIG. 17). The screens 22 are connected to core 129 either directly of indirectly by conductive elements within the armatures 16 that are used to form an axis bus (FIG. 10). Each of the center cubelets 15 and slave cubelets 20 and 25 have sufficient display electronics to display an image on screens 22. There are numerous embodiments that can be created. The images displayed on screens 22 are preferably a series Red, Green, Blue (RGB) light intensities, still images used to form a larger image on each side 6 of cube 10 or full motion video. Each screen 22, forming ⅙ of the still image or video (FIG. 17). Hence each of the images on a side 6 can be used to provide the puzzle similar to that of a prior art Rubik's Cube® but instead of a single color on a side being used to form the puzzle to be solved a larger image on each side 6 is created form a series of smaller images or image fragments.

In preferred embodiments the images that are placed on the screens 22 are dynamic and configurable. The images are preferably changed through sophisticated electronics, internal gyroscopes and accelerometers, that can sense the X,Y,Z axis movement in which cube 10 is being held in three-dimensional space. The combination of these sophisticated electronics and equally sophisticated software algorithms can detect motion-sensitive gestures and respond accordingly through sophisticated software algorithms thus configuring itself and changing itself in real-time based on user generated gestures. The images, video, state or function of cube 10, for example, are preferably made to change dynamically through various hand gestures. One such example is that cube 10 is in the sate of a traditional prior art Rubik's® cube, with the traditional six colors on each face of the puzzle (White, Yellow, Red, Orange, Blue Green) and then, by pressing a center cubelet, 15, (one of the six center pieces) and performing a gesture in three-dimensional space (i.e. three quick clockwise gestures), the puzzle will change "modes" from puzzle to "picture frame mode". Showing full images on each of the six sides and cycling through a series of images held in the puzzle's internal non-volatile memory at a user or system pre-configured interval. Hence, cube 10 has the ability to be a 360-degree picture frame, in addition to all the other sophisticated modes of operations that are detailed herewith.

Cube 10 is preferably enabled to interface with a computer or other processing device that will provide data for the screens 22. The interface is preferably a port (i.e. USB port) built into cube 10 or the interface may be a wireless interface built into cube 10 (i.e. Bluetooth, WiFi, etc.). Digital photographs and video images may be displayed on the sides (FIGS. 15 and 17).

Cube 10 is preferably provided with a "time out" setting that will cause the system to go into "sleep mode" if the timeout expires wherein either; the screens 22 turn off, or alternatively, the screens 22 begin a predetermined display mode, either displaying still images or a predetermined video. Cube 10 is preferably programmed to go into a "clock mode" if the time out expires wherein the system can perform the same functionality as a digital desktop clock. In a clock mode the sides 6 can show the same clock image or various clock images may be shown on different sides 6 (displaying different time zones; California, Paris, New York, Berlin etc., for example). Cube 10 is preferably provided with a "screen saver mode" causing a preconfigured banner to rotate around cube 10. (for example a rotating banner, "Alexia's iToy" . . . ). Cube 10 can play "slide shows" based on images being cycled within a predetermined amount of time for the sides 6.

Cube 10 is preferably provided with audio and particular audio may be provided for a given image display. For example, if the screen saver or banner was a seascape then the audio could be the sound of waves and seagulls. If the screen saver were a photo slide show profile, the audio could be voices associated with the photos. The audio could accompany video clips on the sides 6 of cube 10.

Cube 10 can function as a puzzle similar to a prior art Rubik's Cube®. Each of the sides 6 presents an image that is preselected either through an automated process or by the user. One of many advantages over the traditional prior art Rubik's Cube® device is that the number of puzzles (a minimum of 256) is configurable and selectable by the user. Additionally, cube 10 has the ability to digitally scramble or unscramble itself upon command—through user gestures in three-dimensional space. Thus, the scrambling may be associated with a level of complexity that is preferably readily controlled through scramble algorithms that may be applied to color or image profiles. The exact same level of scrambling is preferably tried by different users—by applying the exact same scramble algorithm (which resides in cube 10, internal non-volatile memory) to the exact same image profile. The puzzle is preferably 'instructed' to unscramble itself, again through user gestures in three-dimensional space, thereby reprogramming the cubelets 15,20 and 25 to display the image associated with its corresponding side 6.

Cube 10 is preferably provided with the ability to wirelessly stream the data to other devices or to wirelessly receive data from other devices.

FIG. 10 illustrates the internal workings of cube 10. The cubelets 15, 20 and 25 (center, corner and edge) can contain sophisticated processing device (such as gyroscopes, accelerometers, CPU, Digital Signal Processors, ASICS, FPGAs or microcontrollers) or other similar device that can provide data and command/control data packets to the slave cubelets 20 and 25. The processing devices within the cubelets 15, 20 and 25 are responsible for running software algorithms that are used to control the binary images for cube 10. The system, 10 will typically have a certain amount of memory to support the processing element. The memory within the system 10 is preferably RAM (Random Access Memory), Flash (non-volatile computer storage) memory or a combination of volatile and non-volatile memory.

Figure 17B:
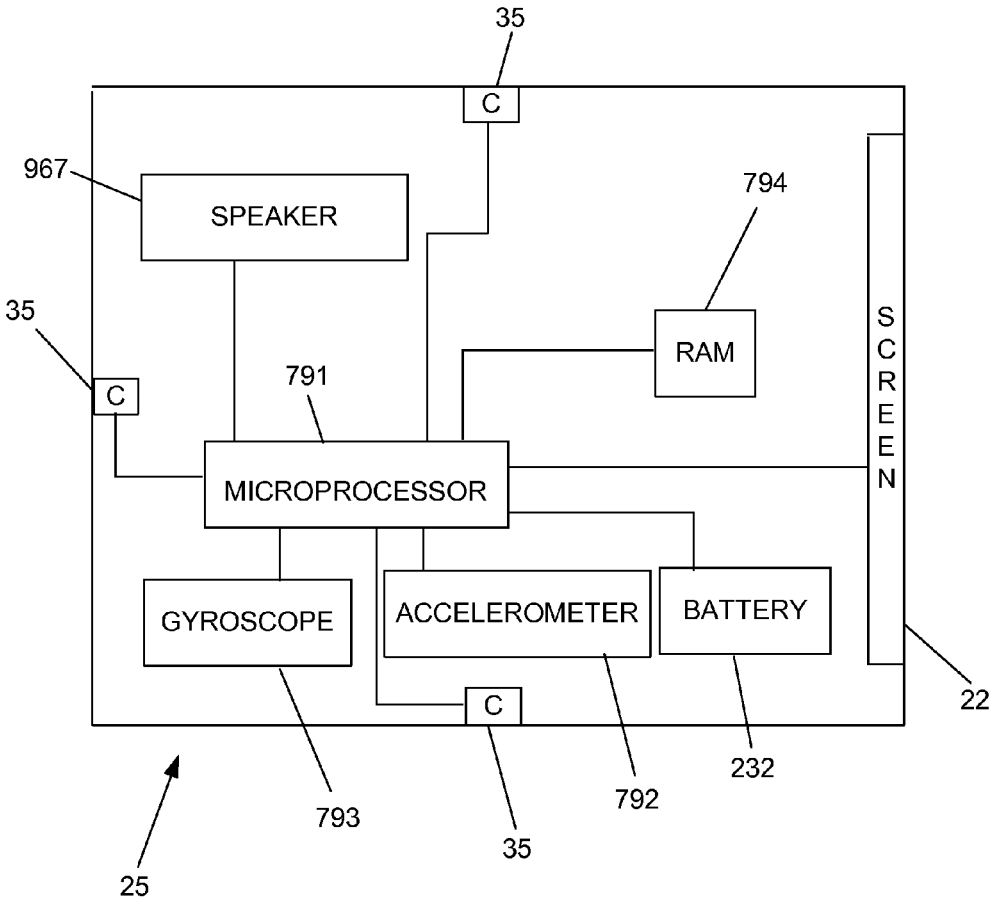
FIG. 17B shows a preferred cubelet.

For example, FIG. 17B shows center cubelet 15. Microprocessor 791 is powered by battery 232. Information and power is transferred to other cubelets via connectors 35, as discussed above. Screen 22 is controlled by microprocessor 791. Microprocessor 791 accesses RAM 794 as shown. Inputs to microprocessor 791 are provided via accelerometer 792 and gyroscope 793.

Algorithms performed by microprocessor 791 will perform the tasks associated with the functionality of cube 10. These functions can include, but are not limited to: establishing and maintaining connection (wired or wireless) with a host computational element. As used herein, a computational element is preferably a Windows® based personal computer, a Mac® based personal computer, a Linux based personal computer, a personal digital assistant (PDA) or any other such software/hardware configuration that can assume the role of providing data such as an iPod®. In this context, a computational element could also be a digital camera or a cellular telephone; transferring data to and from cube 10; providing data that is displayed on the screens 22; scrambling images on the screens 22; de-scrambling images on screens 22; slide show functionality; video functionality; audio functionality; control of a PIN code to lock or unlock the functionality of cube 10.

Figure 9:
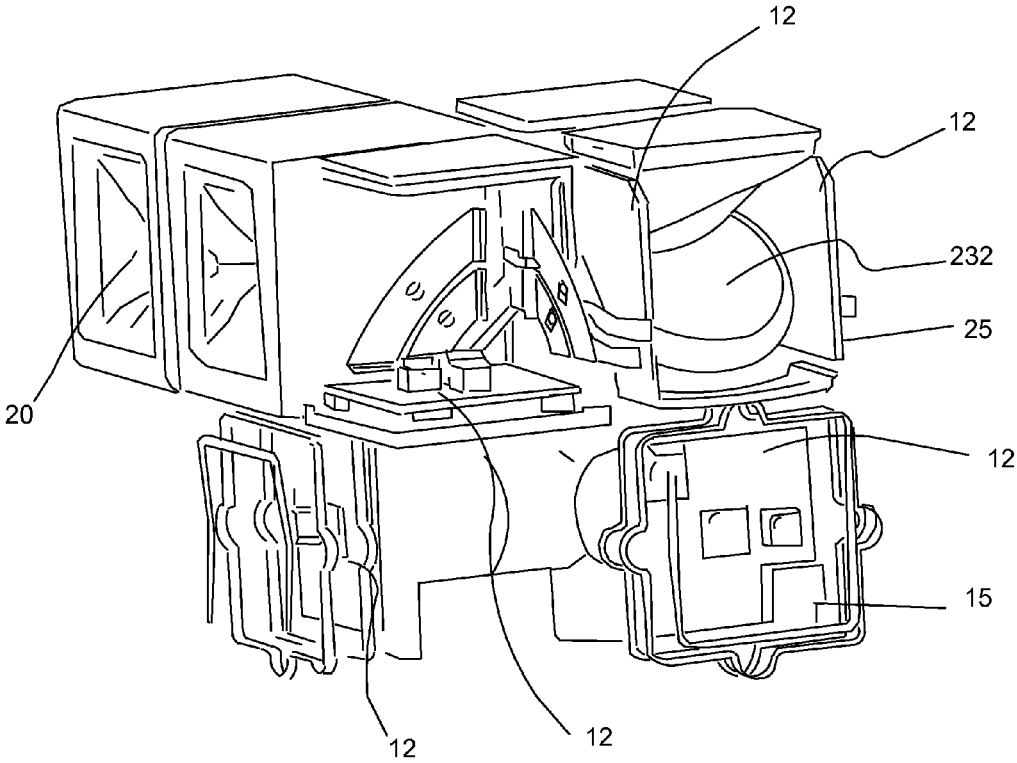
FIG. 9 shows electronics inside a preferred cubelet.

Cube 10 is preferably provided with docking facilities or a custom docking station (FIG. 7). Extended functionality can also be provided once cube 10 is docked. Cube 10 will support an interface to connect to a computational element. The connection is preferably a universal Serial Bus (USB) or other conventional hardwire type of interface. A hardwired interface can also be used to charge an internal battery or batteries 232 contained within cube 10 (FIG. 9). The interface can also be any conventional wireless interface. This interface can serve multiple purposes including: transferring data from a computational element to cube 10 using "synching" or handshaking techniques. Embodiments can support standard plug-n-play functionality know within the computer arts. A computational element configured with the software is preferably made to recognize the introduction of 'new hardware' and will install the necessary software drivers to work seamlessly with cube 10.

Once cube 10 is docked with a computational element, and during first time setup, an embodiment will have the user presented with an option of registering cube 10 over the internet (an internet connection will be necessary to register on-line) as well as the option to launch the software.

The software to cube 10 is preferably designed to provide synchronization capabilities of the digital content within cube 10 and configure its behavior.

Embodiments are envisioned wherein cube 10 will have an open architecture. An application programming interface (API) is preferably made available to third party developers. An open architecture allows third party developers to develop software plug-ins for cube 10 that can provide extended capabilities, such as transition effects for slide show images or different screen savers.

In an embodiment, a process will provide that third party candidates enter into a contractual obligation with parties owning the intellectual property to cube 10 or responsible for marketing cube 10. A certification division is preferably created that will certify that plug-in conform to required best practices design and implementation guidelines and in no way makes cube 10 unstable. Once certification is obtained, the plug-in will be posted on the internet where it is preferably downloaded and installed into cube 10. This process can include free plug-in modules or various fee arrangements for plug-in modules. A plug-in module is preferably downloaded for a one time fee, a specific number of uses or for a predetermined time period. Various embodiments can provide models that allow third party developers to develop plug-ins.

Another embodiment will have cube 10 contain software that can load the plug-ins into cube 10. The software is preferably open source, free software or proprietary software. Cube 10 software will synchronize with a computational element to enable cube 10 to download the plug-ins. The software is preferably used to form part of cube 10 that will be recognizable to the computational element within a plug and play environment or a portion of the proprietary software is preferably installed on the computational element. Data can then be placed within cube 10 for substantially any digital format including: images; video; audio (mp3, way files etc.) or generally any type of multimedia. This data is preferably stored in cube 10's internal non-volatile memory. The data connection transferring data may be wired, for example USB, Ethernet or wireless, for example Bluetooth, ZigBee (IEEE 802.15.4) or any of the various versions of IEEE 802.xx, for example. The functionality of cube 10 should remain the same regardless of the type of transfer mechanism that is employed to move data to-from cube 10 and the computational element.

Another embodiment provides cube 10 with the capability to organize the digital media. Cube 10 is preferably provided with a sophisticated Graphical User Interface (GUI) (hosted on the computational element) allowing the user to organize the digital media contained within cube 10. Images/photos, video and audio are preferably arranged by persons in general or restricted to those that have administrator privileges such as a password or PIN number. Screens 22 are preferably provided with touch sensitivity to control the GUI for cube 10 or other control mechanisms are preferably applied to control the GUI such as control by the computation element, docking station or an input for a control device such as a Infrared (IR) remote control, wireless keyboard or a mouse, etc. Further embodiments can have the GUI for cube 10 controlled by the computational device itself.

Embodiments for the computational element resident graphical user interface (GUI) used for cube 10 can employ "Tabs" to access each logical group. FIGS. 25-29 show computer monitor screen printouts of preferred GUI screens with which a user can interface with to control cube 10.

Images can be selected and placed into folders, selected from folders or entire folders are preferably selected. Folders, hard drives or other storage media are preferably scanned for image formats (.bmp, jpg, tiff, jpeg200 etc.). Folders are preferably placed within a computational element and selected while cube 10 is interfacing with the computational element. In another preferred embodiment cube 10 is provided with a storage device or sufficient memory and the folders are preferably placed within cube 10 itself. Once selected, files or folders are preferably operated on or transferred. Multimedia files that are transferred to cube 10 may undergo a reformatting (transcoding) process to optimize these files for use with cube 10. Files (images, video and/or audio) are preferably compressed, decompressed, scaled either up or down, or have formats changed (i.e. bmp to jpg, .mp3 to way, etc) to support proper use and/or display on cube 10.

In a preferred embodiment cube 10 is provided with a password or PIN to "lock/unlock" cube 10.

Another embodiment will provide for the GUI to be able to select puzzles to be employed with cube 10. System software is preferably provided to control the GUI, as previously discussed. One such puzzle is to have six different images with one image to be used on each side 6 of cube 10 for a given puzzle. Cube 10 software can provide numerous puzzles using various images that are display on the screens 22. Cube 10 software can provide a slide show of images. Additionally, an audio theme is preferably associated with each image or each slide show. Setting transition time between images or setting musical themes to be played for each a specific parameter; where parameter is preferably a folder, video or slide show. Cube 10 could be programmed according to various embodiments to provide settings for sleep or timeouts periods. For example, cube 10 can go into sleep mode if not in use for 5 minutes. The sleep mode is preferably intended to conserve power, or change to "clock mode" or turn on screen saver mode.

In another embodiment, cube 10 is preferably programmed to provide a startup banner upon being turned on. For example, cube 10 can display a startup banner that is user configurable reading "Alexia's Cube" or "Antonio's Cube", etc. The banner can rotate around the sides 6 until a predetermined time, such as once cube 10 has fully booted (ready for user interaction). The banner could also be displayed if cube 10 goes into a screen saver mode, similar to a Windows® based PC once a screen saver is active. The banner within an embodiment, however, is preferably displayed on all sides 6 in three dimensional mode if so desired.

As previously described, cube 10 in a cube shaped embodiment can function as a Rubik's Cube®. The sides 6 have screens 22 that are dynamic and configurable by the user. The user via cube 10 software preferably selects digital images for a puzzle that will be displayed on the sides 6 for the currently active puzzle. The user can select the puzzle by interacting with cube 10. In one particular embodiment, cube 10 is preferably activated using an accelerometer to detect if cube 10 has been moved.

Each side 6 of the cube embodiment for cube 10 is preferably thought of as a monitor similar that found on modern day laptops or flat panel displays (or cellular phones). The difference being that the manner of display of the monitor has been altered. By dividing the monitor into 3×3 cubelets, the pixel resolution of the monitor formed on a side 6 will be the three times the resolution of any individual cell. Thus, if each center cubelet 15 and edge cubelet 25 or corner cubelet 20 was to a have a resolution of 341×256 pixels, the entire monitor formed on a side 6 could be viewed as the sum having a total resolution 1024×768 pixels.

Alternatively, the monitor formed on a side 6 could be made up of a mini-LCD or OLED (Organic Light Emitting Diodes) displays made up of many pixels in a common format, such as 160×160 pixels. These types of displays are currently in common use. Thus the resulting monitor would have a resolution of 480×480 and images or videos could be converted to fit within this resolution.

As previously discussed above, as seen in FIG. 9 sophisticated electronics are housed in each cubelet: center 15, edge 25 and corner 20. The cubelets contain various electronic elements such as a processing element and a communication mechanism. The communication mechanism can have a two fold purpose. The first purpose would be to send or receive data to/from the cubelets. This data would typically be some type of multimedia data such as audio, video, images or a combination thereof. The second purpose would be to ensure that cube 10 receives the power to display on the cubelet face or in the case of any nine cubelets on a given side, to display the data for the face of the cube.

As previously discussed, the processing element can range from a relatively simple microcontroller to a rather sophisticated microprocessor. The term processing element as used herein broadly refers to any device that can provide the functionality for cube 10. This could be a microprocessor, a microcontroller, an (application specific integrated circuit (ASIC), filed programmable gate array (FPGA), digital signal processor (DSP) or other technology that can perform the functionality required by cube 10.

The master (preferably one of the four corner cubelets) cubelet is responsible for performing all the operations required for interfacing various parts of cube 10, such as continuously querying all slave pieces for their current status, in terms of proper electronic functionality as well as system state (i.e. is the cube in a solved state, is the battery level low, etc.).

In an embodiment as shown in FIG. 10, the armatures 16 mechanically connect the center cubelets 15 to the core 129. Connector springs 35 (FIG. 13), form the redundant data and power distribution bus. Bus is a common term in the industry and defines a connection mechanism through which data or power is imparted to other parts of cube 10. This bus is referred to herein as the data over power (DoP) bus and provides both the electrical and data connection necessary to interface all cubelets 15, 20, 25 to cube 10. The DoP bus is comprised of custom spring connectors 35, which are designed with a curved "head" allowing the cubelets (15,20, 25) to easily rotate or roll over the plastic surface of the outer cubelet walls. The spring connectors 35 are soldered in place to the connector plates 45 (FIG. 13) and protrude through openings in the cubelet walls as discussed earlier. The electronics are installed within the individual cubelets 15, and 25 as shown in FIG. 9.

As shown in FIG. 9, the inside cavity of every edge piece 25 preferably holds a battery 232. There are twelve edge pieces (in a "cube" embodiment example) in cube 10, thus twelve rechargeable batteries provide redundant power paths to cube 10. Also, as shown in FIG. 9, corner piece 20 preferably includes an accelerometer and a speaker (not shown).

As shown in FIG. 8, there are custom spring connectors protruding from all four sides of every center and edge cubelets (15, 20) and from each of three sides for corner 25, cubelets. This assures a constant and redundant data and power connection at all times throughout cube 10, regardless of the orientation of any face at any given time.

FIG. 17 is an illustration of a fully assembled cube. From this image one can see how each face of a cubelet is a screen or ⅙ the area of the full screen or face. FIG. 17 also shows the end resultant cube 10 once all the cubelets are properly positioned. Thus, each of the six sides to the cube is preferably a single display screen and the display device can function as a multi-sides digital picture frame when not being manipulated as a puzzle. The display device can also be used to display video and play audio.

Different geometric shapes could possibly have more or fewer cubelets. While an embodiment of a "cube" (3×3×3) allow users to identify cube 10, with the well know Rubik's Cube® and provide an enjoyable puzzle, puzzles can also be made out of other three dimensional geometric shapes. For example, instead of a cube shape, the system could be shaped as a pyramid and the puzzle could still be played by rotating pieces about three axes.

Various pyramid embodiments could be implemented. One type of pyramid embodiment could function as a display. In a display embodiment the pyramid could display images or video and these images could be visible from multiple sides. In another embodiment, the pyramid shape could be formed into sections that could be rotated to form a puzzle similar to a Rubik's Cube®. Section could be made to rotate about multiple axes. Further embodiments could be made to rotate about three axes.

Embodiments are possible that can have greater or fewer than six faces. In a preferred embodiment, there are fewer faces by reducing the number of rotational axes or by simply using fewer cubelets and employing an addressing/connection scheme for the remaining cubelets to receive power and data.

FIG. 8 illustrates the internal cavities of the cubelets. The cubelet cavities house the electronics that are central to the system and act as the "neural network" of the system. The basic elements within the cubelets are generally referred to as the CPU. The term CPU as used herein may be a processor, a microprocessor (μP), microcontroller (μC), digital signal processor (DSP), gate array, programmable gate array (PGA), field programmable gate array (FPGA) or other application specific integrated circuit (ASIC) type of device, or a combination of these elements. These elements are ultimately assembled onto a printed circuit board (PCB) 987 as shown in FIG. 14. PCB 987 also includes memory used by the neural network and system in general.

A power source for the system may be located in any cubelet. An embodiment as shown in FIG. 9 depicts battery 232 located in edge cubelet 25.

The cubelet internals housed on PCB 987 preferably includes various peripheral electronics such as but are not limited to: USB, firewire; Bluetooth; Zigbee cores, accelerometers; touch sensitive interfaces; cellular or other type of interface. The selection of the interfaces to be used in any given system is a design choice that can vary according to different embodiments of cube 10.

Figure 6:
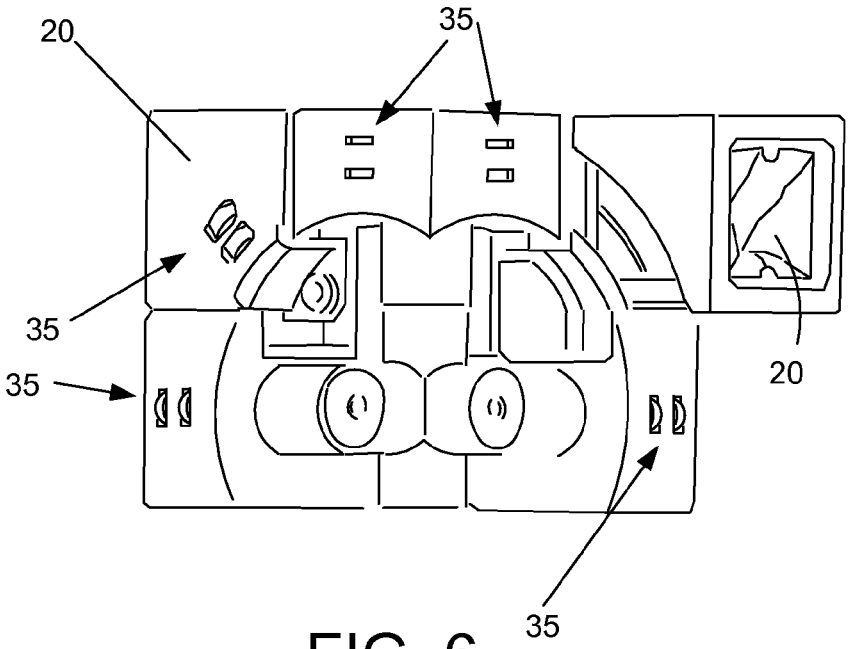
FIG. 6 shows preferred spring pin connectors

The DoP bus provides the transport mechanisms for data and power between the cubelets via the custom spring connectors (FIG. 13) protruding from each of the four sides of the center cubelet 15 as shown in FIG. 6 For the sake of clarity only five of the six center cubelets 15 are shown in FIG. 6. It should be noted that every cubelet has a similar redundant DoP bus architecture. Edge cubelets 25, likewise have four redundant DoP connections and the corner cubelets 20 have three redundant DOP bus connection points.

Figure 18:
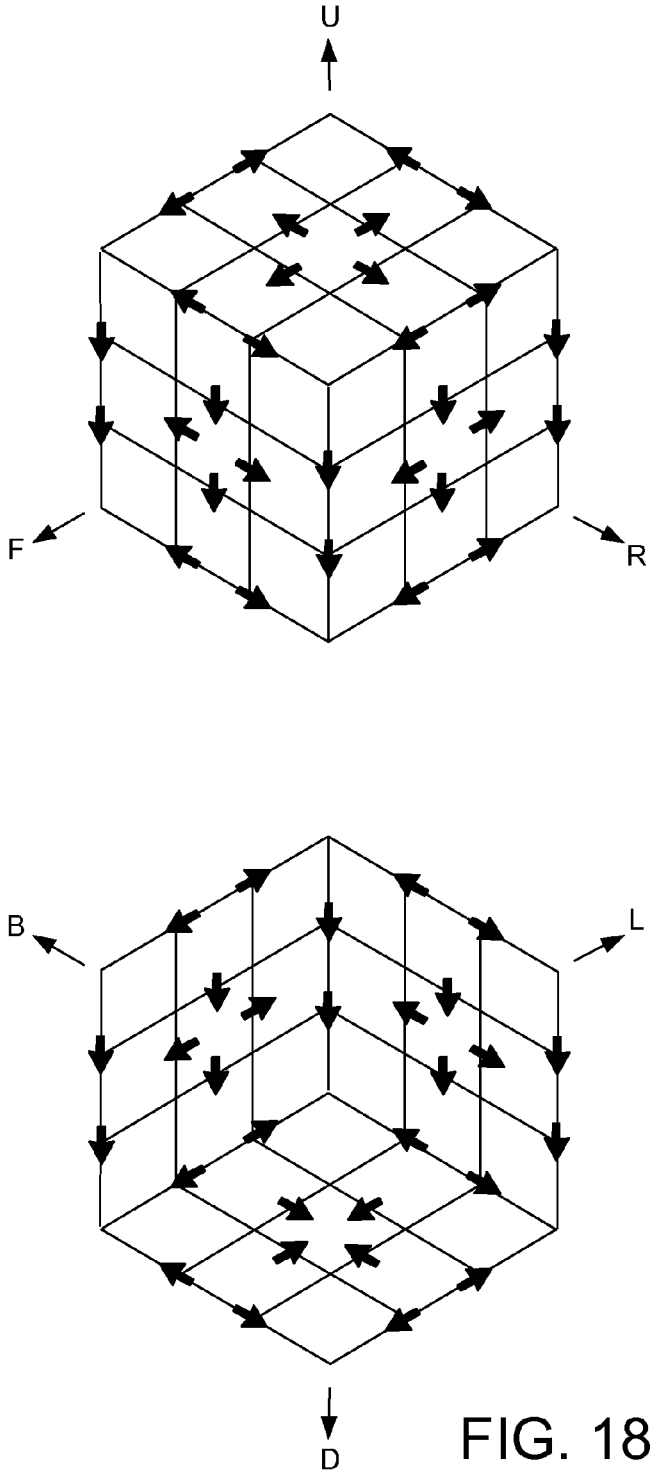
FIG. 18 shows downstream message flow.

Through this redundant DoP bus architecture algorithm logic, command/control/query and other system status and event information is communicated through cube 10 as depicted in FIG. 18.

In order to interact with the configurable capabilities of cube 10, embodiments of cube 10 are preferably designed with touch and motion sensitive technology, similar to those found in today's iPhone™ (i.e. touch sensitive screen, motion sensitive via accelerometer technology etc.)

Cube 10 is preferably provided with touch/motion sensitive interfaces that allows the user to access Administrator capabilities. This allows the user to Enter PIN code to lock/unlock or enter Administrator mode on cube 10. Once in Administrator mode the user has the ability to configure elements, turn cube 10 on or off, select new puzzles, select a slide show to play, associated music themes, descramble a current puzzle on cube 10, select music lists to play or turn wireless capability on/or off, for example.

Electrical and Data Connectivity Maintained While Cube is Manipulated by User A key feature of cube 10 is that electrical and data connectivity is maintained even after cube 10 has been manipulated by the user. In the above paragraphs it was described in detail how a preferred cube 10 is constructed. As shown in FIGS. 12 and 13, custom spring connectors allow for electricity and data to flow even as the cube has been manipulated.

For example, to understand the data and electrical connectivity, it is useful to consider cubelet 3*a* shown in FIGS. 19-23.

Figure 19:
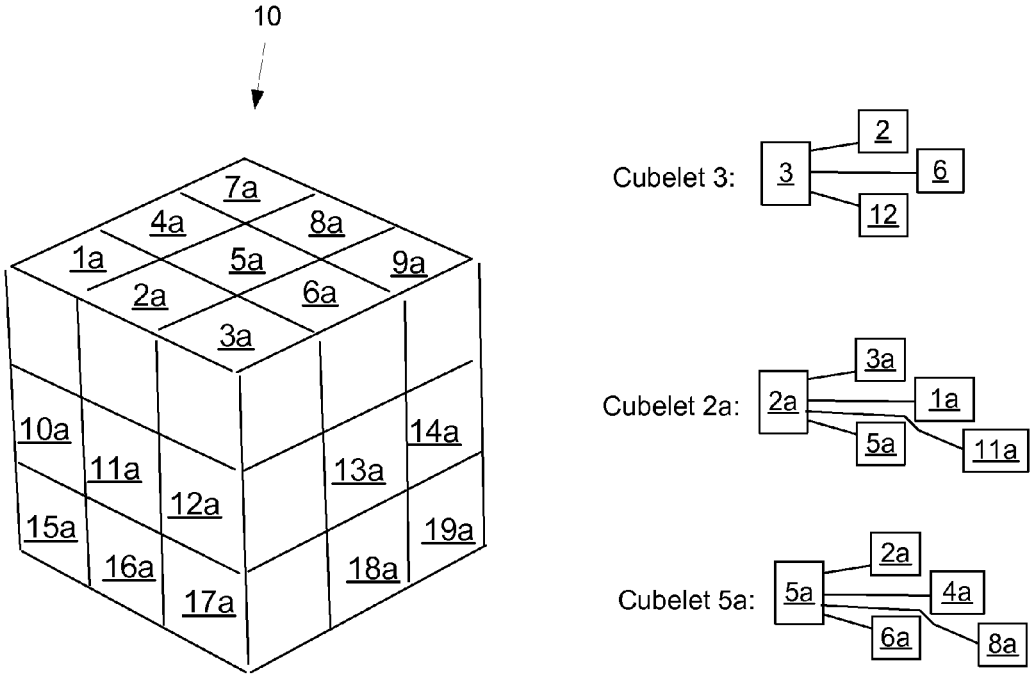
FIGS. 19-23 illustrate data and power connectivity is maintained as a preferred embodiment of the present invention is manipulated by a user.

In FIG. 19, cubelet 3*a* has connectivity with cubelets 2*a*, 6*a* and 12*a*.

Figure 20:
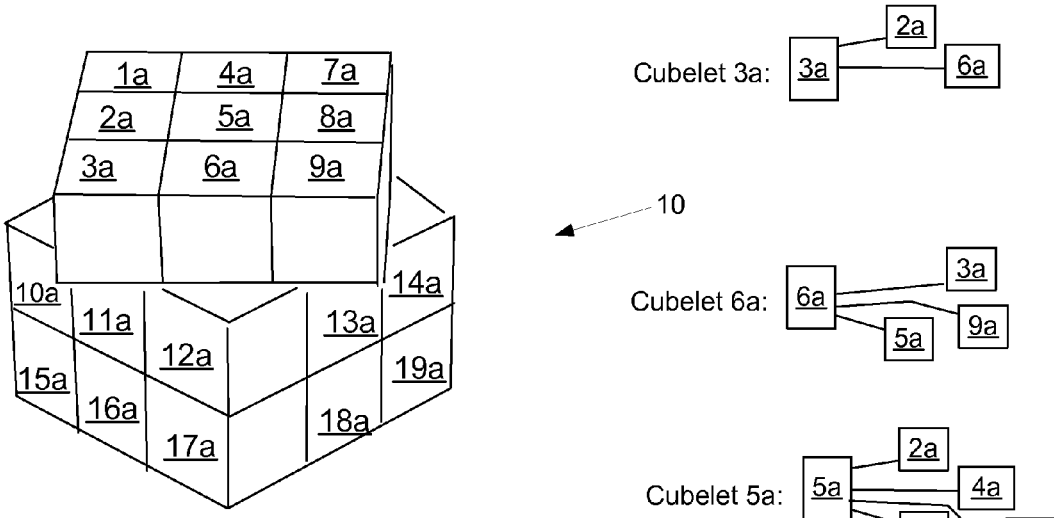

In FIG. 20, the user has turned the top row of cubelet 3*a* clockwise. Cubelet 3*a* has connectivity with cubelets 2*a* and 6*a*.

Figure 21:
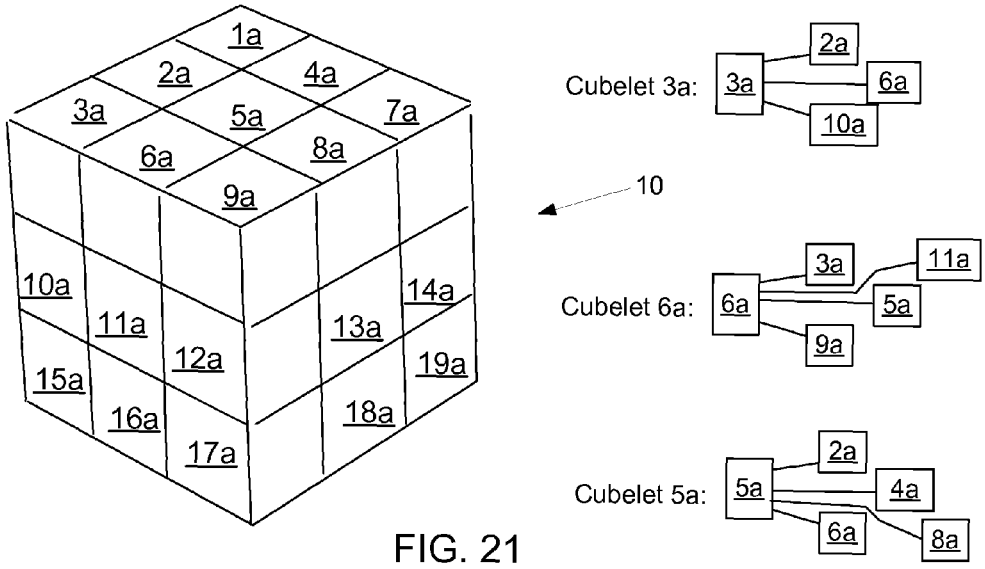

In FIG. 21, the clockwise turn is complete. Cubelet 3 has connectivity with cubelets 2, 6 and 10.

Figure 22:
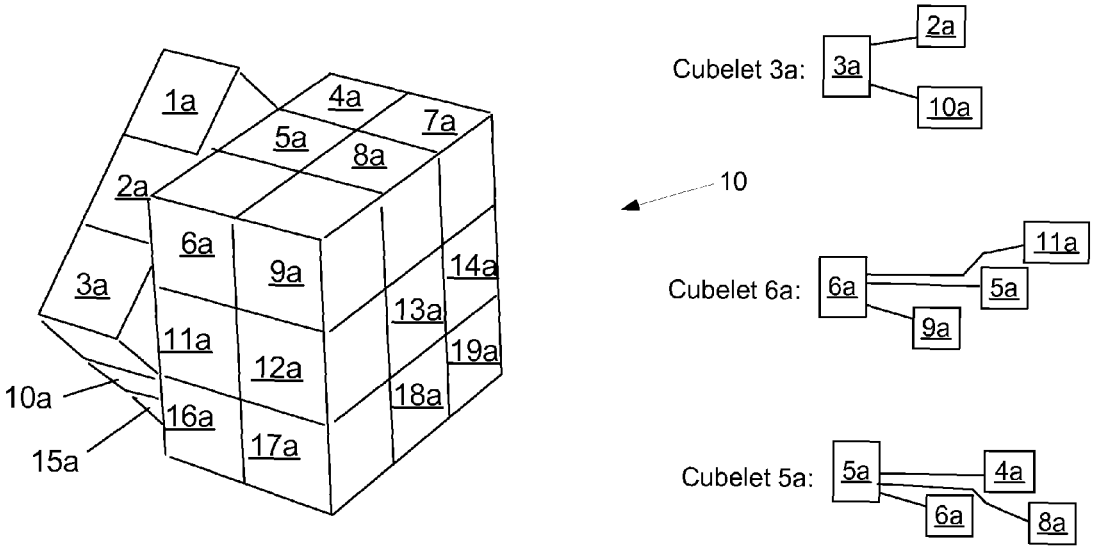

In FIG. 22, the user has rotated the leftmost column forward. Cubelet 3*a* has connectivity with cubelets 2*a* and 10*a*.

Figure 23:
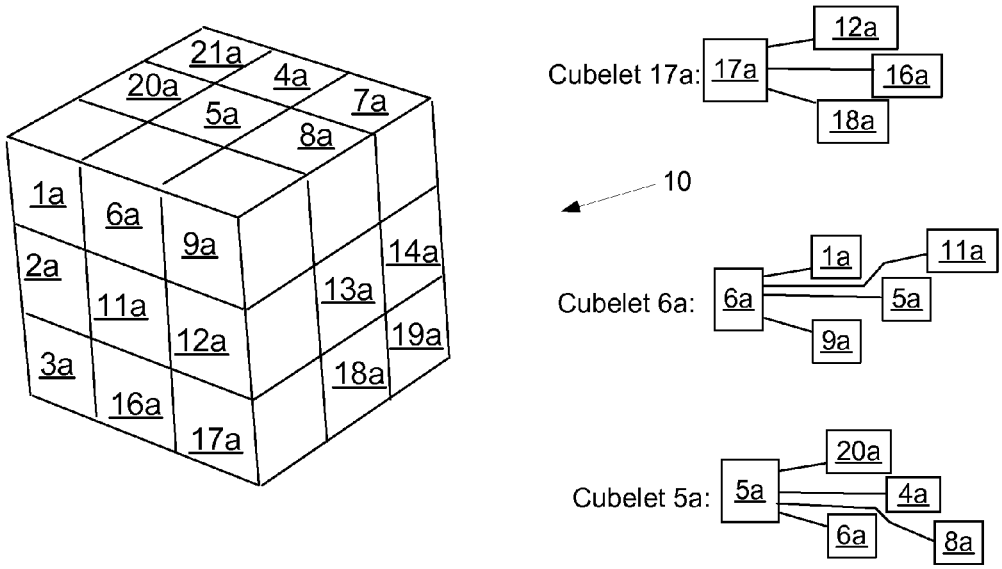

In FIG. 23, the rotation is complete. Cubelet 3*a* has connectivity with cubelets 2*a*, 10*a* (not shown) and 16*a*.

Because electrical and data connectivity is maintained. Images may be displayed on screens 22 regardless of how the user may manipulate cube 10.

Alternate Embodiments

Embodiments using differing geometric shapes are envisioned. One embodiment could employ a cube shape and mechanically function much like a Rubik's Cube® except that electronics are preferably included for managing complex algorithmic analysis as well as managing the display associated with each side (or face) and with each cubelets of any given side. Another embodiment could form a pyramid like shape. Still other embodiments can employ geometric shape with eight or sixteen sides as in a sphere embodiment, for example.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A geometric electronic toy, comprising

A) a center core element,

B) a plurality of axes originating from said center core element,

C) a plurality of cubelets wherein a predetermined number of said plurality of cubelets is rotatable about said plurality of axes, each of said plurality of cubelets comprises at least one display screen to form a plurality of display screens covering said geometric logic toy for displaying preprogrammed images, D) at least one microprocessor in communication with said plurality of display screens, said microprocessor programmed to control the display of images on said plurality of display screens, E) a connection means for maintaining said communication between said at least one microprocessor and said plurality of display screens to provide for the continual display of said images on said plurality of display screens, said communication is maintained during the rotation of said predetermined number of said plurality of cubelets about said plurality of axes.

2. The geometric toy as in claim 1, wherein said geometric toy is in the general shape of a cube, wherein said geometric toy further comprises:

A) eight corner cubelets, and

B) twelve edge cubelets.

3. The geometric toy as in claim 1, wherein said plurality of cubelets comprises:

A) a plurality of center cubelets,

B) a plurality of corner cubelets,

C) a plurality of edge cubelets.

4. The geometric toy as in claim 1, wherein said plurality of center cubelets is six center cubelets, wherein said plurality of corner cubelets is eight corner cubelets, and wherein said plurality of edge cubelets is twelve edge cubelets.

5. The geometric toy as in claim 1, wherein said at least one microprocessor is contained within at least one of said plurality of cubelets.

6. The geometric toy as in claim 1 further comprising at least one battery for providing power to said plurality of cubelets, wherein said at least one battery is contained within at least one of said plurality of cubelets.

7. The geometric toy as in claim 1, wherein said connection means is a plurality of connectors connected to said plurality of cubelets, wherein said plurality of connectors provides continuous electrical and data connectivity to each of said plurality of cubelets as said plurality of cubelets are rotated about said plurality of axes.

8. The geometric toy as in claim 7, wherein said plurality of connectors is a plurality of spring connectors.

* * * * *